United States Patent [19]

Heim et al.

[11] 4,193,412

[45] Mar. 18, 1980

[54] ADDITIVE FOR SMOKING TOBACCO PRODUCTS, FILTER ELEMENTS THEREOF AND PROCESS FOR THE PREPARATION THEREOF

[75] Inventors: Ernst Heim, Denzlingen; Dieter Imbery, Emmendingen; Bruno Kliemann, Freiburg im Breisgau, all of Fed. Rep. of Germany

[73] Assignee: Rhodia AG, Freiburg im Breisgau, Fed. Rep. of Germany

[21] Appl. No.: 862,400

[22] Filed: Dec. 20, 1977

[30] Foreign Application Priority Data

Dec. 23, 1976 [DE] Fed. Rep. of Germany ..... 2658479

[51] Int. Cl.[2] ..... A24B 15/00; A24B 15/027

[52] U.S. Cl. ..... 131/264; 131/17 R; 131/15 R; 55/387; 55/512

[58] Field of Search ..... 131/17, 9, 10, 10 R, 131/10.1, 10.5, 10.7, 10.3, 140 R, 10.9, 2, 261 R, 262 R, 264, 263, 266

[56] References Cited

U.S. PATENT DOCUMENTS

| | | | |
|---|---|---|---|
| 1,972,718 | 9/1934 | Sharlit | 131/17 R |
| 2,007,407 | 7/1935 | Sadtler | 131/9 |
| 2,114,281 | 7/1938 | Allen | 131/17 R |
| 2,967,118 | 1/1961 | Gary et al. | 131/17 R |
| 3,049,449 | 8/1962 | Allegrini | 131/17 R |
| 3,087,500 | 4/1963 | Jacobson | 131/17 R |
| 3,669,126 | 6/1972 | Soussa et al. | 131/10.9 |
| 3,878,854 | 4/1975 | Albein et al. | 131/266 |

*Primary Examiner*—Vincent Millin

*Attorney, Agent, or Firm*—Bucknam and Archer

[57] ABSTRACT

An additive for smoking tobacco products and their filter elements is described which comprises an intimate mixture of at least two highly dispersed metal oxides or metal oxyhydrates, mixtures thereof or a mixture of different forms of the same metal oxide or metal oxyhydrate, the mixture exhibiting liquid-like properties anomalous for a mixture of solids, and specific properties of the mixture, such as the bulk density, the surface area, the flowability and the absorption capacity for gases and vapors not representing an additive value of the proportions of the mixing components, and the absorption capacity for toxic substances in the tobacco smoke being synergistically increased.

16 Claims, No Drawings

ADDITIVE FOR SMOKING TOBACCO PRODUCTS, FILTER ELEMENTS THEREOF AND PROCESS FOR THE PREPARATION THEREOF

This invention relates to an additive for smoking tobacco products and their filter elements, and more specifically it relates to smoking tobacco products and their filter elements made from different metal oxides and/or metal oxyhydrates with large specific surface. The invention also relates to a process for the preparation of these additives.

During the combustion of tobacco a multitude of substances is liberated, some of which have or may have a toxic effect on the health of the smoker. A large part of these toxic substances is found in the so-called particulate phase of the tobacco smoke which constitutes an aerosol and may be separated from it as condensate, the common designation for it being tar. A series of substances of this type, however, is also found in the gaseous phase.

Many solutions have been proposed to reduce the toxic substances in tobacco smoke, and recently, these efforts have been increased throughout the world because of the increasing concern with the matter of health of the smoker.

On one hand, it is possible to change the tobacco used for smoking articles, for instance by the selection of appropriate varieties of tobacco or by special aftertreatment processes. On the other hand, considerable efforts have been made to develop tobacco substitutes. These efforts aim at reducing the formation of the toxic substances, especially tar, during combustion and the substitutes have already application in mixtures with natural tobacco. Different components may also be removed by filtration of the tobacco smoke, by inserting filters made for instance of paper or cellulose-2,5-acetate fibers. The latter, namely the cellulose acetate filters, have won general acceptance, especially in cigarettes, because of several advantages.

In further known processes for the reduction of toxic components of tobacco smoke, substances with absorbent action are used which are added to the filter or to the tobacco. These are mainly products with large specific surface such as activated charcoal, silica gels, natural and synthetic silicates of a great variety, also ion exchange resins and molecular sieves, also metal oxides, oxyhydrates and hydroxides, mainly of aluminum, iron, and magnesium, also finely divided cereal starch and flour and powdered sugar.

Several of these substances have also been used as mixtures.

For instance German Auslegeschrift No. 2,206,185 describes a smoking product, consisting of a foil on a cellulose base, carbonized at a low temperature, which contains hydroxides, oxides, oxyhydrates of aluminum and/or iron and/or silica as filler. The product of German Offenlegungsschrift No. 2,262,329 is similar. The production of tobacco smoke filters, which contain for instance a mixture of silica and activated alumina, is known from German Auslegeschrift No. 1,274,946.

In addition, a tobacco smoke filter is described in British Pat. No. 1,103,822, consisting of a powdered or granulated material such as activated charcoal, silica gel, aluminum oxide, etc. or their mixtures. The same is also knwon from British Pat. No. 1,104,993 and U.S. Pat. No. 3,313,306, where, among others, metal oxides such as aluminum oxide, iron oxide, etc. and their mixtures are mentioned.

In conclusion therefore it can be said that it is known to add different metal oxides and/or metal oxyhydrates with large specific surface, alone or in combination, to smoking tobacco products and their filters.

The properties of these known combinations of metal oxides and/or metal oxhydrates such as for instance the absorbing power for toxic substances in tobacco smoke, are as to be expected, that is to say they are additive corresponding to the amounts of their single components.

When these combinations of metal oxides and/or metal oxyhydrates are prepared in the usual way, for instance by stirring or shaking etc. of the components, one does not obtain homogeneous mixtures. This lack of homogeneity is noted for instance in the coagulation of the particles and so leads to the formation of agglomerates. This formation of agglomerates of the metal oxide and/or metal oxhydrate particles leads to poor pouring, poor sprinkling and poor flowing properties of the mixture. This in turn leads to difficulties when it is intended to add several metal oxides and/or metal oxyhydrates together to smoking products and their filter elements, since an uneven distribution of the additive results on or in the basic materials of which these smoking tobacco products or the filter elements are prepared.

One object of the present invention is therefore to provide an additive for smoking tobacco products and their filter elements consisting of different metal oxides and/or metal oxyhydrates and to provide a process for the preparation of this additive, in which the components of the additive are so combined that the handling of this additive is improved and an easier and more even distribution on or in the basic materials of the smoking tobacco products or the filter elements is made possible. Another object is to provide an additive for smoking tobacco products and their filter elements in which expecially the ability to remove toxic substances from the tobacco smoke exceeds the ability of known additives as much as possible.

The crux of the present invention resides in the fact that an additive for smoking tobacco products and their filter elements which consists of different metal oxides and/or metal oxyhydrates with large specific surface may be prepared in which the additive consists of an intimate mixture of highly disperse metal oxides and/or metal oxyhydrates, and that this mixture exhibits liquid-like properties, anomalous for a mixture of solids, and that certain properties of the mixture, like bulk density, surface area, ability to flow, absorptive power for gases and vapors, do not represent the sum of the properties of the component parts of the mixture and the absorptive power for toxic substances in tobacco smoke is synergistically increased.

The term "different metal oxides and/or metal oxyhydrates" is intended to mean also different forms of the same metal, for instance amorphous, precipitated silicon dioxide and pyrogenic silicon dioxide.

According to a preferred embodiment of the invention, the additive consists of a mixture of the oxides and/or oxyhydrates of aluminum and/or calcium and/or magnesium and/or silicon and/or titanium.

The process for the preparation of the additive according to the invention consists of introducing together different highly disperse metal oxides and/or metal oxyhydrates together into a large amount of a low boiling liquid or mixture of liquids under vigorous stirring, the liquid or liquids having no solvent power for the highly disperse metal oxides and/or metal oxyhydrates, and subsequently the liquid or the mixture of liquids is completely removed. The term "vigorous stirring" means a rate of stirring of about 600–700 revolutions per minute, because under different conditions sedimentation occurs. The term "highly disperse" herein means that the maximum average particle size is about 25 micrometers.

According to a preferred embodiment of the process according to the invention, oxides and/or oxyhydrates of aluminum and/or calcium and/or magnesium and/or silicon and/or titanium are used for the preparation of the additive.

The metal oxides and metal oxyhydrates used within the scope of the invention are, on the one hand, aerogel powders obtained by the high temperature decomposition of the chlorides, such as pyrogenic aluminum oxide, silicon dioxide, and titanium dioxide, or on the other hand, xerogel or microcrystalline powders obtained by precipitation or crystallization from salt solutions and subsequent drying/dehydration, such as precipitated aluminum oxide, oxyhydrate, or hydroxide, calcium and magnesium oxide, silicon dioxide and titanium dioxide.

The following examples are described in detail hereinbelow for the purpose of illustration but are not intended to limit the scope of the invention.

EXAMPLE 1

The production of an additive according to the invention was carried out from the following substances:

(a) silicon dioxide (silica), precipitated, amorphous, average particle size 25 micrometers.

(b) aluminum oxyhydrate (aluminum hydroxide), precipitated, crystalline, (gamma structure), average particle size 300 nanometers ($10^{-9}$ meters) corresponding to the description in German Pat. No. 2,227,291).

These substances to be mixed were introduced in the proportion of 70% by weight of silicon dioxide to 30% by weight of aluminum oxyhydrate into 5 times their weight of a mixture of 24 volume parts ethanol and 1 volume part water under vigorous stirring. The vigorous stirring was then continued for a period of three hours. Under continuous stirring, the suspension was then warmed, while at the same time the pressure was progressively reduced by means of a vacuum pump, and at the same time dry air was continuously aspirated through the material. This operation was continued until the liquid was completely removed.

The powder so obtained was then equilibrated at 20° C. and 60% relative humidity. The powder is obtained in a loose, very fine form and exhibits liquid-like properties, namely easy mobility and therefore good pouring, sprinkling, and flowing properties.

The substance according to the invention, prepared as described, consisting of silicon dioxide and aluminum oxyhydrate represents an excellent additive for smoking tobacco products and their filter elements, as shown in tables 1 and 5.

EXAMPLE 2

The preparation of an additive according to the invention was carried out from the following substances:

(a) silicon dioxide, as in example 1;

(b) silicon dioxide (silica), pyrogenic, amorphous, average particle size 12 nanometers.

These substances to be mixed were introduced in the proportion of 30% by weight of precipitated silicon dioxide, to 70% by weight silicon dioxide, pyrogenic, into three times their weight of liquid air under vigorous stirring.

The remaining steps of the process corresponded to those of example 1, with the advantage that the use of liquid air permitted to omit the evacuation and the aspiration of air.

A powder was obtained which had liquid-like properties comparable to the powder prepared according to example 1.

The data in table 4 show that the resulting substance according to the invention from precipitated silicon dioxide and pyrogenic silicon dioxide is also an excellent additive within the scope of the invention.

In addition to the liquids described hereinabove, other liquids may serve for the preparation of the additives according to the invention, as long as they have no solvent properties for the substances used.

Other starting materials used for the examples in the tables for the preparation of the additive according to the invention exhibited the following average particle size:

| | | |
|---|---|---|
| titanium dioxide, pyrogenic | 30 | nanometers |
| aluminum oxide, pyrogenic | 20 | nanometers |
| magnesium oxide, calcined | 1 | micrometers |
| calcium oxide, calcined | 500 | nanometers |
| aluminum oxide, calcined | 3 | micrometers |

The preparation of the substance according to the invention as a stable adduct from several metal oxides and/or metal oxyhydrates may be based on the following mechanisms: Since all starting materials used are metallic compounds, they all have a polar character so that the most diversified interactions are possible between their surfaces, such as complex formation of the different metal ions, hydrogen bond formation, partial salt formation, ion exchange; also electric/electrostatic effects which may lead to repulsion/attraction of the particles. For instance, after shaking in a glass vessel, pyrogenic silica carries a negative surface charge, but precipitated silica carries a positive charge; pyrogenic titanium dioxide carries a positive charge; crystalline aluminum hydroxide carried a positive charge; but aluminum oxide obtained by calcination of aluminum hydroxide carries a negative charge; pyrogenic aluminum oxide carries no charge, and magnesium oxide also carries no charge. Which formation mechanisms are actually involved cannot be deducted from the knowledge presently available.

The additive according to the invention can be added to smoking products and their filter elements according to known procedures.

So, the additive may be applied to, or powdered on, the surface of the basic materials from which the smoking tobacco products and the filter elements are prepared. Suitable processes for this step are described for instance in Austrian Pat. Nos. 318,456 and 208,278.

The additive may also be worked or spun into the basic materials from which the smoking tobacco products and the filter elements are prepared, in the manner as described e.g. in German Offenlegungsschrift No. 2,109,919.

The invention is explained in more detail in the tables, in which the reported results represent average values from multiple determinations.

Tables 1 to 2 show comparison experiments with different varieties of tobacco and different additives.

The synthetic tobacco mentioned in table 1 was prepared essentially according to the methods described in German Offenlegungsschrift No. 1,900,491 especially example 9 therein with the type of filler material being varied corresponding to the data given in table 1.

The natural tobacco used in tables 1 and 2 is the tobacco blend of light and dark tobacco varieties of a commercial cigarette type; the inorganic additives were distributed homogeneously on the tobacco surface. The cigarettes used in table 2 were prepared without filter from a tobacco pretreated in this manner in a length of 70 mm for the smoking test according to a predetermined weight and draw resistance.

The pyrolysis results reported in table 1 were obtained under definite conditions, namely at 800° C and an air flow of 17.5 ml/second. The precipitation of the smoke condensate was obtained on a "Cambridge filter" according to specification CORESTA (CENTRE DE COOPERATION POUR LES RECHERCHES SCIENTIFIQUES RELATIVES AU TABAC).

The smoking of the cigarettes according to table 2 proceeded to a stub length of 8 mm on a Borgwaldt smoking machine, capacity 30 cigarettes with electrostatic separation of the condensate from the smoke. The experimental details and analyses were carried out according to the corresponding CORESTA specifications.

As is clearly demonstrated in tables 1 and 2, the reduction of the toxic components in tobacco smoke which is found is not the consequence of an especially high or an especially low specific surface of the used additives, but is always due to the application of the special substance according to the invention by which the far best results were obtained; this is equally true for natural tobacco which carries the added material on its surface as for synthetic tobacco in which the additive has been incorporated into the mass, even when it is present in a mixture with natural tobacco, as indicated by table 1.

Tables 3 to 8 contain comparative tests with filter cigarettes with different additives added to the filter.

For the filter cigarettes, a uniform cord of natural tobacco was used, the tobacco of which corresponded to the tobacco mixture of light and dark tobacco varieties of the commercial cigarette used in tables 1 and 2.

The filters used for the filter cigarettes had a draw resistance of 80 mm water column and had a diameter of 7.9 mm and a length of 20 mm. These filters were prepared from a tow of crimped cellulose-2,5-acetate filaments with a single filament titer of 2.1 denier and a y-shaped cross-section.

The total length of the cigarettes used in tables 3 to 8 was 85 mm.

The smoking of the cigarettes according to tables 3 to 7 was continued to a stub length of 28 mm with 20 mm filter and 8 mm residual tobacco under the conditions indicated in table 2.

In direct contrast, the results in table 8 are obtained on a smoking machine having only the capacity of a single cigarette with condensate precipitation on a "cambridge filter". The other smoking conditions followed also the CORESTA specifications.

The total gaseous phase of the tobacco smoke, of the tobacco component passing the "Cambridge filter", according to definition, was trapped in the collecting cylinder of the smoking machine and then analyzed by gas chromatography.

The column used for the gas chromatographic separation of the individual substances was 2 m long and contained as filler Porapak Q supplied by the Varian Company.

All filters contained the inorganic additives in an amount of 3% by weight and in uniform distribution on the surface of their basic material, the cellulose acetate fibers.

Tables 3 to 8 also show that the reduction of the toxic components, in the tobacco smoke is not attributable to an especially high or especially low specific surface of the used additives. but again it is due to the use of the additive according to the invention by which the best results are obtained.

In addition, table 8 shows that the special additive according to the invention not only diminishes the condensate content in the smoke in a surprising manner, but it also reduces to an unforeseeable degree the polar components of the organic gaseous phase of the tobacco smoke, such as for example acetaldehyde, acetonitrile, and acrolein.

The aluminum oxyhydrate used may be replaced without disadvantage by aluminum oxide monohydrate (Al00H, boehmite) crystalline (gamma structure) with average particle size of 100 nanometers. The same applies when the described calcium oxide is replaced by titanium dioxide, precipitated, crystalline (anatase modification) with an average particle size of 300 nanometers.

Table 1

Pyrolysis Results From Smoking Tobacco With Inorganic Additives

| Additive (all amounts given in percent by weight) | | bulk density (g/l) | specific surface ($m^2/g$) | Water vapor absorption (weight %) at 60% relative humidity and 20° C. | I. Natural Tobacco | II. Mixtures in the weight ratio of 1:1 of natural and synthetic tobacco* |
|---|---|---|---|---|---|---|
| | | | | | Tar (mg/g pyrolyzable substance) | |
| without (as comparison) | | | | | 198 | |
| (a) $MgCO_3$ | 28.2 | 147 | | | | 122 |
| $CaCO_3$ | 28.2 | | | | | |
| Diatomaceous earth | 43.6 | | | | | |
| (b) Aluminum oxyhydrate (aluminum hydroxide), precipitated; crystalline (gamma structure) | | 315 | 8 | 1.0 | | 120 |
| (C) Silicon dioxide (silica), precipitated, amorphous | | 88 | 667 | 25.8 | | 102 |

Table 1-continued

| Pyrolysis Results From Smoking Tobacco With Inorganic Additives | | | | | |
|---|---|---|---|---|---|
| Additive (all amounts given in percent by weight) | bulk density (g/l) | specific surface ($m^2/g$) | Water vapor absorption (weight %) at 60% relative humidity and 20° C. | I. Natural Tobacco | II. Mixtures in the weight ratio of 1:1 of natural and synthetic tobacco* |
| | | | | Tar (mg/g pyrolyzable substance) | |
| (d) Mixture according to the invention of (b) and (c) 50:50 | 237 | 275 | 4.9 | | 80 |
| (e) Mixture according to the invention of (b) and (c) 30:70 | 198 | 425 | 7.5 | | 58 |

*The synthetic tobacco consists of 25.1% by weight carboxymethylcellulose, 9.1% by weight bone glue, 1.4% by weight glycerol, 0.6% by weight bone black, and 63.8% by weight inorganic additive.

Table 2

| Smoking-off Results With Cigarettes (without filter) From Natural Tobacco With 10% by Weight Inorganic Additives | | | | | |
|---|---|---|---|---|---|
| Additive (all amounts given in percent by weight) | Condensate (moist) in smoke | Water in condensate | Tar in condensate | Nicotine in tar | Phenol in tar |
| | all values in mg/cigarette | | | | |
| without (as comparison) | 31.7 | 5.4 | 26.3 | 1.60 | 0.169 |
| (a) Aluminum oxyhydrate corresponding to table 1, (b) | 21.4 | 3.6 | 17.8 | 1.08 | 0.169 |
| (b) Silicon dioxide, corresponding to table 1, (c) | 21.7 | 3.6 | 18.1 | 1.14 | 0.142 |
| (c) Mixture according to invention of (a) and (b) 50:50 | 16.8 | 5.0 | 11.8 | 0.74 | 0.080 |

Table 3

| Smoking-off Results With Filter Cigarettes With Inorganic Additives in the Amount of 3% by Weight With Respect to the Filter | | | | | |
|---|---|---|---|---|---|
| Additive: pyrogenic metal oxides (all amounts in weight percent) | Bulk density (g/l) | Specific Surface ($m^2/g$) | Water vapor absorption (wt. %) at 60% relative humidity and 20° C. | Filter Efficiency: Nicotine Retention (%) | Filter Efficiency: Tar Retention (%) |
| without (as comparison) | | | | 49 | 50 |
| (1) titanium dioxide, pyrogenic, crystalline (partially rutile, predominantly anatase modification) | 88 | 53 | 1.4 | 57 | 57 |
| (2) silicon dioxide (silica) pyrogenic, amorphous) | 40 | 252 | 1.5 | 67 | 62 |
| (3) mixture according to the invention of (1) and (2) 70:30 | 91 | 96 | 1.6 | 56 | 57 |
| (4) mixture according to the invention of (1) and (2) 30:70 | 64 | 312 | 1.9 | 68 | 64 |
| (5) aluminum oxide, pyrogenic, crystalline (little delta, predominantly gamma structure) | 60 | 103 | 3.5 | 62 | 64 |
| (6) mixture according to the invention of (2) and (5), 50:50 | 62 | 153 | 4.3 | 64 | 65 |
| (7) mixture according to the invention of (2) and (5), 70:30 | 62 | 163 | 7.5 | 67 | 66 |
| (8) mixture according to the invention of (2) and (5), 84:16 | 59 | 184 | 12.5 | 72 | 69 |

Table 4

| Smoking-Off Results with Filter Cigarettes With Inorganic Additives In The Amount Of 3% by Weight With Respect to the Filter | | | | | |
|---|---|---|---|---|---|
| Additive: pyrogenic and precipitative metal oxides (all amounts in weight percent) | Bulk Density (g/l) | Specific Surface ($m^2/g$) | Water Vapor absorption (wt. %) at 60% relative humidity and 20° C. | Filter Efficiency: Nicotine Retention (%) | Filter Efficiency: Tar Retention (%) |
| without (as comparison) | | | | 49 | 50 |

Table 4-continued

Smoking-Off Results with Filter Cigarettes With Inorganic Additives In The Amount Of 3% by Weight With Respect to the Filter Additive: pyrogenic and precipitative metal oxides (all amounts in weight percent)

| | Bulk Density (g/l) | Specific Surface ($m^2/g$) | Water Vapor absorption (wt. %) at 60% relative humidity and 20° C. | Filter Efficiency Nicotine Retention (%) | Filter Efficiency Tar Retention (%) |
|---|---|---|---|---|---|
| (2) corresponding to table 3, (2) | 40 | 252 | 1.5 | 67 | 62 |
| (9) silicon dioxide (silica) precipitated, amorphous | 95 | 455 | 22.5 | 52 | 51 |
| (10) mixture according to the invention of (2) and (9) 30:70 | 104 | 312 | 6.7 | 63 | 60 |
| (11) mixture according to the invention of (2) and (9) 50:50 | 79 | 288 | 5.5 | 66 | 60 |
| (12) mixture according to the invention of (2) and (9) 70:30 | 70 | 246 | 4.4 | 69 | 63 |
| (13) Aluminum oxyhydrate (aluminum hydroxide) precipitated, crystalline (gamma structure) | 315 | 8 | 1.0 | 56 | 57 |
| (14) mixture according to the invention of (2) and (13) 30:70 | 164 | 49 | 1.7 | 62 | 61 |
| (15) mixture according to the invention of (2) and (13) 50:50 | 100 | 106 | 1.8 | 64 | 62 |
| (16) mixture according to the invention of (2) and (13) 80:20 | 68 | 176 | 1.7 | 71 | 66 |

Table 5

Smoking-Off Results With Filter Cigarettes With Inorganic Additives In The Amount of 3 Weight Percent With Respect to the Filter Additive: precipitated metal oxides (all amounts given in weight percent)

| | Bulk Density (g/l) | Specific Surface ($m^2/g$) | Water vapor absorption (wt. %) at 60% relative humidity and 20° C. | Filter Efficiency Nicotine Retention (%) | Filter Efficiency Tar Retention (%) |
|---|---|---|---|---|---|
| without (as comparison) | | | | 49 | 50 |
| (9) corresponding to table 4, (9) | 95 | 455 | 22.5 | 52 | 51 |
| (13) corresponding to table 4, (13) | 315 | 8 | 1.0 | 56 | 57 |
| (17) mixture according to invention of (9) and (13), 70:30 | 198 | 275 | 3.5 | 60 | 58 |
| (18) mixture according to invention of (9) and (13), 84:16 | 108 | 420 | 4.4 | 64 | 59 |
| (19) mixture according to invention of (9) and (13), 80:20 | 113 | 405 | 3.6 | 65 | 61 |

Table 6

Smoking-Off Results With Filter Cigarettes With Inorganic Additives In The Amount of 3% by Weight With Respect to the Filter Additive: Precipitated and calcined metal oxides (all amounts given in percent by weight)

| | Bulk Density (g/l) | Specific Surface ($m^2/g$) | Water vapor absorption (wt %) at 60% relative humidity and 20° C. | Filter Efficiency Nicotine Retention (%) | Filter Efficiency Tar Retention (%) |
|---|---|---|---|---|---|
| without (as comparison) | | | | 49 | 50 |
| (9) corresponding to table 4, (9) | 95 | 455 | 22.5 | 52 | 51 |
| (20) magnesium oxide, calcined; crystalline (cubic) | 303 | 34 | 10.5 | 52 | 53 |
| (21) mixture according to invention of (9) and (20) 70:30 | 435 | 308 | 18.4 | 62 | 58 |
| (22) calcium oxide, calcined; crystalline (cubic) | 455 | 3.5 | 39.4 | 51 | 54 |
| (23) mixture according to invention of (9) and (22) 80:20 | 90 | 324 | 6.6 | 62 | 62 |

Table 7

Smoking-Off Results With Filter Cigarettes With Inorganic Additives In The Amount of 3% by Weight With Respect To The Filter

| Additive: calcined metal oxides (all amounts given in percent by weight) | Bulk Density (g/l) | Specific Surface ($m^2/g$) | Water vapor absorption (wt. %) at 60% relative humidity and 20° C. | Filter Efficiency Nicotine Retention (%) | Filter Efficiency Tar Retention (%) |
|---|---|---|---|---|---|
| without (as comparison) | | | | 49 | 50 |
| (20) corresponding to table 6, (20) | 303 | 34 | 10.5 | 52 | 53 |
| (24) aluminum oxide, calcined; crystalline (gamma structure) | 354 | 215 | 8.0 | 51 | 51 |
| (25) mixture according to invention of (20) and (24) 30:70 | 208 | 231 | 10.9 | 57 | 60 |

Table 8

Smoking-Off Results With Filter Cigarettes With Inorganic Additives In The Amount Of 3% By Weight With Respect to the Filter

| Additive: (all amounts given in percent by weight) | Filter Efficiency: Particulate Phase Nicotine Retention (%) | Particulate Phase Tar Retention (%) | Gaseous Phase Acetaldehyde Retention (%) | Gaseous Phase Acetonitrile Retention (%) | Gaseous Phase Acrolein Retention (%) |
|---|---|---|---|---|---|
| without (as comparison) | 49 | 50 | 0 | 0 | 0 |
| pyrogenic metal oxides: silicon dioxide, pyrogenic, corresponding to table 3, (2) | 67 | 62 | 4 | 0 | 0 |
| aluminum oxide, pyrogenic, corresponding to table 3, (5) | 62 | 64 | 1 | 0 | 1 |
| mixture according to invention of (2) and (5) 84:16 corresponding to table 3, (8) | 72 | 69 | 20 | 32 | 22 |
| pyrogenic and precipitated metal oxides: silicon dioxide, pyrogenic, corresponding to table 3, (2) | 67 | 62 | 4 | 0 | 0 |
| aluminum oxyhydrate, precipitated, corresponding to table 4, (13) | 56 | 57 | 0 | 4 | 0 |
| mixture according to invention of (2) and (13) 80:20 corresponding to table 4, (16) | 71 | 66 | 21 | 23 | 25 |
| precipitated metal oxides silicon dioxide, precipitated, corresponding to table 4, (9) | 52 | 51 | 6 | 15 | 25 |
| aluminum oxyhydrate, precipitated, corresponding to table 4, (13) | 56 | 57 | 0 | 4 | 0 |
| mixture according to invention of (9) and (13) 80:20, corresponding to table 5, (19) | 65 | 61 | 15 | 22 | 23 |

After the effect of the single metal oxides, oxyhydrates, and the mixtures according to the invention is determined, it is obvious also to combine such mixtures with each other and/or with other individual components within the scope of the invention.

The advantages obtained according to the invention as compared to the state of the art may be particularly appreciated if one considers that the combination of the appropriate highly dispersed metal oxides and/or metal oxyhydrates according to the invention leads to an additive for smoking tobacco products and their filter elements which is easier to handle, so that a more uniform distribution on or in the basic materials of the smoking tobacco products and the filters is obtained. The results demonstrate that the additive according to the invention exhibits optimal properties for the reduction of toxic components of tobacco smoke.

We claim:

1. An additive for smoking tobacco products and their filter elements, which is a member selected from the group consisting of (1) an intimate mixture of at least two highly dispersed metal oxides having a large specific surface area; (2) an intimate mixture of at least two highly dispersed metal oxyhydrates having a large specific surface area; (3) an intimate mixture of at least one highly dispersed metal oxide and at least one metal oxyhydrate both having a large specific surface area; (4) an intimate mixture of different forms of the same metal oxide; (5) an intimate mixture of different forms of the same metal oxyhydrate, the mixture exhibiting liquid-like properties anomalous for a mixture of solids, and specific properties of the mixture, such as the bulk density, the surface area, the flowability and the absorption capacity for gases and vapors not representing an additive value of the proportions of the mixing components, and the absorption capacity for toxic substances in the tobacco smoke being synergistically increased.

2. An additive according to claim 1, which comprises a mixture of the oxides and oxyhydrates of aluminum, calcium, magnesium, silicon and titanium.

3. An additive according to claim 2, which comprises a mixture of silicon dioxide and aluminum oxyhydrate.

4. An additive according to claim 2, which comprises a mixture of silicon dioxide and aluminum oxide.

5. An additive according to claim 2, which comprises a mixture of precipitated silicon dioxide and pyrogenic silicon dioxide.

6. An additive according to claim 2, which comprises a mixture of silicon dioxide and titanium dioxide.

7. An additive according to claim 2, which comprises a mixture of silicon dioxide and magnesium oxide.

8. An additive according to claim 2, which comprises a mixture of silicon dioxide and calcium oxide.

9. An additive according to claim 2, which comprises a mixture of magnesium oxide and aluminum oxide.

10. An additive according to claim 2, wherein aluminum oxyhydrate is aluminum oxyhydrate (aluminum hydroxide), precipitated, cristalline (gamma structure), of average particle size 300 nanometers; silicon dioxide is silicon dioxide (silica), precipitated, amorphous, of average particle size 25 micrometers; silicon dioxide is silicon dioxide (silica), pyrogenic, amorphous, of average particle size 12 nanometers; titanium dioxide is titanium dioxide, pyrogenic, cristalline (partially rutile, predominantly anatase modification), of average particle size 30 nanometers; aluminum oxide is aluminum oxide, pyrogenic, cristalline (little delta, predominantly gamma structure), of average particle size 20 nanometers; magnesium oxide is magnesium oxide, calcined, cristalline (cubic), of average particle size 1 micrometer; calcium dioxide is calcium oxide, calcined, cristalline (cubic), of average particle size 500 nanometers; aluminum oxide is aluminum oxide, calcined, cristalline (gamma structure), of average particle size 3 micrometers, aluminum oxyhydrate is aluminum oxymonohydrate (AlOOH, boehmite), cristalline (gamma structure), of average particle size 100 nanometers; titanium dioxide is titanium dioxide, precipitated, cristalline (anatase modification), of average particle size 300 nanometers.

11. Process for the preparation of the additive according to claim 1, which comprises the steps of introducing at least two highly disperse metal oxides or metal oxyhydrates or mixtures thereof or mixtures of different forms of the same metal oxides or metal oxyhydrates together into a large amount of an essentially non-aqueous low boiling liquid or liquid mixture which is not a solvent for said highly disperse metal oxides and metal oxyhydrates under vigorous agitation and then removing said liquid or liquid mixture completely.

12. Process according to claim 11 wherein the highly disperse metal oxides or metal oxyhydrates are the oxides or oxyhydrates of aluminum, calcium, magnesium, silicon or titanium.

13. Process according to claim 11 wherein the liquid or the liquid mixture is a liquid or a liquid mixture with a maximum boiling point of 100° C.

14. The process according to claim 11 wherein vigorous agitation is carried out at 600–700 revolutions per minute for a period of three hours.

15. The process according to claim 11 wherein said liquid is ethanol or liquid air.

16. The additive according to claim 1 wherein said highly dispersed metal oxides and metal oxyhydrates have maximum average particle size about 25 micrometers.

* * * * *